US007354297B2

(12) United States Patent
Tsukashima et al.

(10) Patent No.: US 7,354,297 B2
(45) Date of Patent: Apr. 8, 2008

(54) CONNECTOR FIXING STRUCTURE

(75) Inventors: Hiroyuki Tsukashima, Toyota (JP); Takamasa Takeuchi, Anjo (JP); Kazumoto Konda, Yokkaichi (JP); Sho Miyazaki, Yokkaichi (JP)

(73) Assignees: Toyota Jidosha Kabushiki Kaisha, Toyota (JP); Aisin AW Co., Ltd., Anjo (JP); Autonetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/583,384

(22) PCT Filed: Feb. 15, 2005

(86) PCT No.: PCT/JP2005/002686

§ 371 (c)(1),
(2), (4) Date: Jun. 19, 2006

(87) PCT Pub. No.: WO2005/078869

PCT Pub. Date: Aug. 25, 2005

(65) Prior Publication Data

US 2007/0123105 A1 May 31, 2007

(30) Foreign Application Priority Data

Feb. 17, 2004 (JP) ..... 2004-040164

(51) Int. Cl.
*H01R 13/58* (2006.01)

(52) U.S. Cl. ..... 439/449; 439/373; 439/470; 439/368; 439/371

(58) Field of Classification Search ..... 439/452, 439/579, 470, 373, 371, 368, 942, 362
See application file for complete search history.

(56) References Cited

U.S. PATENT DOCUMENTS

| | | | | |
|---|---|---|---|---|
| 4,424,407 | A * | 1/1984 | Barbic | 174/67 |
| 4,475,785 | A * | 10/1984 | Muller et al. | 439/298 |
| 5,964,611 | A * | 10/1999 | Jacob et al. | 439/372 |

FOREIGN PATENT DOCUMENTS

| | | |
|---|---|---|
| JP | U-39-033728 | 11/1964 |
| JP | U-57-043586 | 3/1982 |
| JP | U-63-033579 | 3/1988 |
| JP | U-03-017679 | 2/1991 |
| JP | 3-227592 | * 10/1991 |

(Continued)

*Primary Examiner*—Tho D. Ta
(74) *Attorney, Agent, or Firm*—Oliff & Berridge, PLC

(57) ABSTRACT

A male connector to be connected to a female connector provided at a housing accommodating a vehicle-mounted electrical device includes a contact point to be connected to a contact of the female connector, a cable connected to the contact point, and a shield shell covering the contact point. A fixing structure for the male connector includes a bolt for fixing the shield shell to the housing, on the contact point side, and a clamp for fixing the cable to the housing, on the cable side. The fixed state of the cable established by the clamp is such a state as to allow for more movement of an object to be fixed than does the fixed state of the shield shell established by the bolt.

16 Claims, 5 Drawing Sheets

FOREIGN PATENT DOCUMENTS

| | | |
|---|---|---|
| JP | U-04-035377 | 3/1992 |
| JP | U-04-110206 | 9/1992 |
| JP | U-05-017961 | 3/1993 |
| JP | U-05-045961 | 6/1993 |
| JP | A-06-052928 | 2/1994 |
| JP | A-2002-075557 | 3/2002 |
| JP | A-2003-051693 | 2/2003 |
| JP | A-2003-115357 | 4/2003 |
| JP | A-2003-264040 | 9/2003 |
| JP | A-2003-317876 | 11/2003 |

* cited by examiner

CONNECTOR FIXING STRUCTURE

TECHNICAL FIELD

The present invention relates to a connector fixing structure, and more particularly, to a fixing structure absorbing vibrations in a cable.

BACKGROUND ART

Conventionally, a vehicle such as a Hybrid Vehicle (HV), an Electric Vehicle (EV), or a Fuel Cell Vehicle (FCV) has a plurality of electrical devices mounted thereon. In a vehicle having a rotating electrical machine mounted thereon, for example, electrical devices such as the rotating electrical machine and an inverter are connected to each other via a cable such as a lead wire. At this time, when a cable such as a lead wire is connected to an electrical device, a connector is usually used. In other words, a cable and an electrical device are respectively provided with connectors shaped to be fittable with respect to each other. Each of the connectors serves as a male connector or a female connector and has a contact point for making electrical connection. Therefore, by fitting a male connector into a female connector, their contact points are joined together and electrically connected.

In particular, for connectors connected under the circumstances where vibrations are incessantly caused by a rotating electrical machine, for example, a fixing structure is required for reliable fixing. Therefore, a bolt is fastened, for example, to fix a connector to a housing. The following document discloses a technique of fixing a connector by fastening a bolt.

Japanese Patent Laying-Open No. 2002-75557 discloses a shielded connector in which a shielded electrical wire can be arranged to extend in a direction parallel to a shielded wall facing thereto, and which can be downsized. The shielded connector is formed such that a housing, which covers a terminal portion of the shielded electrical wire, accommodates a proximal end of a terminal fitting that is pressure-bonded to a core wire of the shielded electrical wire. The shielded connector is attached to fit in a through hole formed in the shielded wall facing thereto. A shield layer of the shielded electrical wire is connected to the shielded wall facing thereto in an electrically conducting manner, and at the same time, a tip of the terminal fitting is held in such a state that it protrudes into the shielded wall facing thereto. In the shielded connector, the terminal fitting is formed such that a flat plate portion, which is contiguously formed from a portion to be pressure-bonded to the core wire, is bent into an L-shape as a whole. The terminal fitting is covered with an insulating member from its proximal end to a portion closer to the tip. A shielding member is provided in the housing for covering an outer periphery of the insulating member that covers the terminal fitting. One end of the shielding member is contiguous to, or connected in an electrically conducting manner to, the shield layer of the shielded electrical wire, while the other end thereof is placed at a portion where the housing abuts against the shielded wall facing thereto.

According to the shielded connector disclosed in the above-described document, when the housing of the shielded connector is attached to the shielded wall facing thereto, the terminal fitting, which is pressure-bonded to the core wire of the shielded electrical wire, protrudes into the shielded wall, at one end of the housing. At the other end of the housing, the shielded electrical wire is arranged to extend in parallel with the shielded wall facing thereto. Here, the terminal fitting is formed such that the flat plate portion, which extends from the pressure-bonded portion, is bent into an L-shape to form a right angle. Since the fiat plate portion can be bent with a bending radius smaller than that of the shielded electrical wire, the bent portion thereof can be made smaller, resulting in downsizing of the entire shielded connector.

However, if a rotating electrical machine is mounted on an HV vehicle of a Front engine Rear drive (FR) type, for example, the rotating electrical machine is required to be mounted in the vehicle's center tunnel, which has a limited mounting space. Therefore, if the rotating electrical machine is initially mounted and then a connector is assembled thereto, an extremely long cable may be required. Furthermore, the connector assembled to the rotating electrical machine is placed under the severe circumstances where the connector vibrates in accordance with a movement of the rotating electrical machine. Accordingly, it is necessary to improve contact between connectors and reliability of a cable. In other words, it is necessary to fix a connector and a cable to a motor in a reliable manner.

According to Japanese Patent Laying-Open No. 2002-75557, a single bolt is fastened to fix a connector. However, in view of the case where the connector is placed under the circumstances where vibrations are incessantly caused by a rotating electrical machine and the like, it-is necessary to increase the number of fixed points of a connector and a cable to provide reliable fixing.

If the number of fixed points of a connector and a cable is simply increased, movement of the cable itself is restricted. Therefore, when the cable vibrates, a stress is inevitably focused on the fixed points of the connector and the cable. If a stress is focused on the fixed points of the connector and the cable, the cable repeatedly undergoes a stress caused by vibrations on its fixed points. As a result, lead wires forming the cable degrade with fatigue.

DISCLOSURE OF THE INVENTION

An object of the present invention is to provide a connector fixing structure that absorbs vibrations in a cable.

A connector fixing structure according to the present invention is a fixing structure for a second connector to be connected to a first connector provided at a housing accommodating a vehicle-mounted electrical device. The second connector includes a contact point to be connected to a contact of the first connector, a cable connected to the contact point, and a shielding portion covering the contact point. The fixing structure for the second connector includes: a first fixing member for fixing the shielding portion to the housing, on a side where the contact point is provided; and a second fixing member for fixing the cable to the housing, on a side where the cable is provided. A fixed state of the cable established by the second fixing member is such a state as to allow for more movement of an object to be fixed than does a fixed state of the shielding portion established by the first fixing member.

According to the present invention, the connector fixing structure is a fixing structure for a second connector (e.g. a male connector) to be connected to a first connector (e.g. a female connector) provided at a housing accommodating a vehicle-mounted electrical device (e.g. a rotating electrical machine). The male connector includes a contact point to be connected to a contact of the female connector, a cable connected to the contact point, and a shielding portion covering the contact point. The fixing structure for the male connector includes a first fixing member (e.g. a bolt) for fixing the shielding portion to the housing, on a side where the contact point is provided, and a second fixing member (e.g. a clamp) for fixing the cable to the housing, on a side where the cable is provided. A fixed state of the cable established by the clamp is such a state as to allow for more movement of an object to be fixed (e.g. a fixed point between the shielding portion and the clamp) than does a fixed state of the shielding portion established by the bolt. If the clamp is formed into a shape exhibiting elasticity, the fixed state on the cable side allows for movement. Therefore, when the cable vibrates in accordance with a movement of the rotating electrical machine or a running state of the vehicle, it is possible to allow the clamp, which has a shape exhibiting elasticity, to absorb the vibrations. In other words, it is possible to disperse the stress caused by the vibrations and exerted on the cable, and thereby it is possible to relieve the concentration of stress exerted on the cable. Since the male connector is fixed to the housing on the shielding portion side by fastening the bolt, connection between the contacts can be maintained. Therefore, it is possible to provide a connector fixing structure that absorbs vibrations in a cable.

Preferably, the second fixing member is formed to have elasticity by its shape.

According to the present invention, the second fixing member (e.g. a clamp) is formed to have elasticity by its shape. Accordingly, when the cable vibrates in accordance with a movement of the electrical device (e.g. a rotating electrical machine) or a running state of the vehicle, it is possible to allow the clamp to absorb the vibrations owing to its shape exhibiting elasticity. In other words, it is possible to disperse the stress caused by the vibrations and exerted on the cable, and thereby it is possible to relieve the concentration of stress exerted on the cable.

More preferably, the second fixing member is formed of a metal plate bent into a predetermined shape.

According to the present invention, the second fixing member (e.g. a clamp) is formed of a metal plate bent into a predetermined shape. Accordingly, it is possible to form a bent portion exhibiting elasticity in the clamp between the housing and the shielding portion. In other words, when the cable vibrates in accordance with a movement of the electrical device (e.g. a rotating electrical machine) or a running state of the vehicle, it is possible to allow the bent portion in the clamp to absorb the vibrations. Therefore, it is possible to disperse a stress caused by the vibrations and exerted on the cable, and thereby it is possible to relieve the concentration of stress exerted on the cable.

More preferably, the second fixing member is integrally formed with the shielding portion.

According to the present invention, the second fixing member (e.g. a clamp) is integrally formed with the shielding portion (e.g. a shielding portion). For example, the clamp is integrally formed with the shielding portion by caulking. Accordingly, the number of fixed points for fixing the shielding portion is increased, which can improve the shielding performance thereof If the clamp is formed into a shape exhibiting elasticity, it is possible to absorb a positional offset, namely, a tolerance between the housing and the clamp at their fastened portion.

More preferably, the second connector is formed to conform to a shape of the housing.

According to the present invention, the second connector (e.g. a male connector) is formed to conform to the shape of the housing. Accordingly, if the second fixing member (e.g. a clamp) is formed such that a thin plate such as a flat metal plate is bent to have elasticity, it is possible to prevent the fitted connectors from bulging from the housing when the male connector is fitted into the first connector (e.g. a female connector). Therefore, even in a small space, it is possible to ensure a mounting space for an electrical device (e.g. a rotating electrical machine).

More preferably, the second connector is formed into an L-shape.

According to the present invention, the second connector (e.g. a male connector) is formed into an L-shape. Accordingly, if the second fixing member (e.g. a clamp) is formed such that a thin plate such as a metal plate is bent to have elasticity, it is possible to prevent the fitted connectors from bulging from the housing when the male connector is fitted into the first connector (e.g. a female connector). Therefore, even in a small space, it is possible to ensure a mounting space for an electrical device (e.g. a rotating electrical machine).

More preferably, the electrical device is a vehicle-mounted motor.

According to the present invention, by applying the connector fixing structure to a vehicle-mounted electrical device, namely, a motor (e.g. a vehicle running motor), it is possible to allow the second fixing member (e.g. a clamp) to absorb the vibrations when the cable vibrates in accordance with a movement of the vehicle running motor or a running state of the vehicle. Therefore, it is possible to disperse the stress caused by the vibrations and exerted on the cable, and thereby it is possible to relieve the concentration of stress exerted on the cable.

More preferably, the object to be fixed is the shielding portion.

According to the present invention, a fixed state of the cable established by the second fixing member (e.g. a clamp) is such a state as to allow for more movement of the shielding portion than does a fixed state of the shielding portion established by the first fixing member (e.g. a bolt). Therefore, when the cable vibrates in accordance with a movement of the rotating electrical machine or a running state of the vehicle, it is possible to allow the clamp, which has a shape exhibiting elasticity, to absorb the vibrations.

BEST MODES FOR CARRYING OUT THE INVENTION

Figure 1:
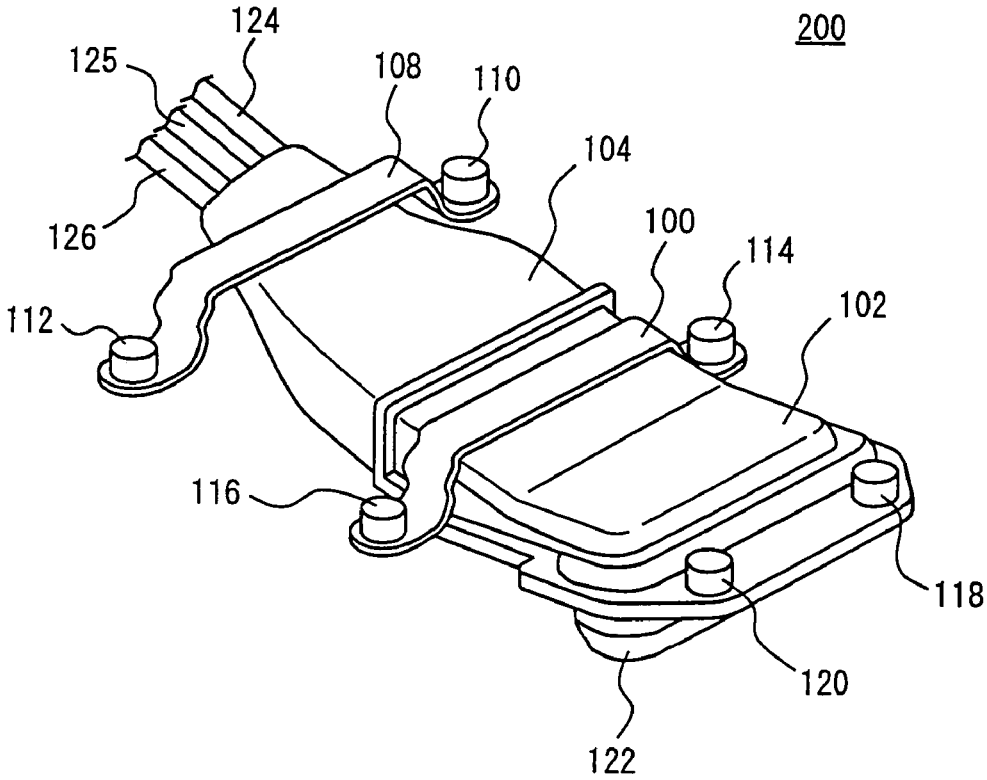
FIG. 1 is an external view of a connector according to a first embodiment of the present invention.

A connector fixing structure according to the embodiments of the present invention will now be described with reference to the drawings by taking a vehicle-mounted rotating electrical machine as an example. In the following description, the same parts are provided with the same reference characters, and the same names and functions as well. Therefore, the detailed description thereof will not be repeated. Furthermore, the connector fixing structure according to the present invention is not limited to the application to a rotating electrical machine. For example, it may be applied to an electrical device such as a vehicle-mounted inverter or converter. The vehicle having a rotating electrical machine mounted thereon is a vehicle such as, but not limited thereto, an HV, EV, or FC having a vehicle running motor mounted thereon.

FIRST EMBODIMENT

A connector according to the present embodiment is composed of a male connector and a female connector. The male connector and the female connector have a contact point and a contact therein, respectively, which correspond to each other. By fitting the male connector into the female connector, their contact point and contact are joined together and electrically connected. The female connector composing the connector according to the present embodiment is provided at a housing of a rotating electrical machine. The male connector to be fitted into the female connector is fixed to the housing in a plurality of positions.

As shown in FIG. 1, a male connector 200 composing a connector according to the present embodiment is composed of a shield shell 102, clamps 100 and 108, bolts 110-120, a cable cover 104, cables 124, 125 and 126, and a connector portion 122.

Each of cables 124, 125 and 126 corresponds to each of the phases of a three-phase alternating current motor, namely, a rotating electrical machine. Each of cables 124, 125 and 126 is connected, at one end, to each of the contact points corresponding thereto, and at the other end, to an inverter (not shown).

Shield shell 102 is formed to cover cables 124, 125 and 126, and the respective contact points thereof Shield shell 102 is formed of metal such as copper to provide shield against an external environment to prevent from being affected by a noise such as an electromagnetic wave coming from the external environment. At shield shell 102, connector portion 122 is formed with the contact points exposed. By fitting connector portion 122 into a connector portion provided at a female connector (not shown), the contact points and the contacts of both of the connectors can be joined together.

Figure 2:
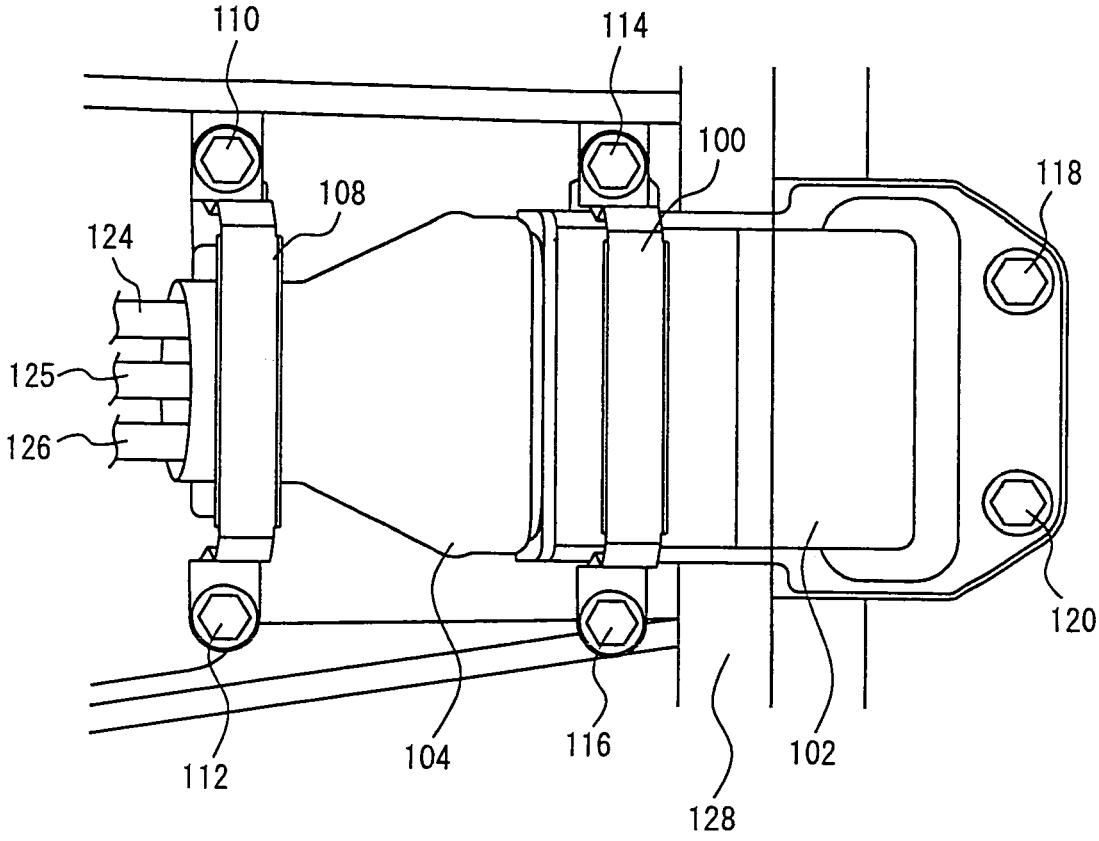
FIG. 2 is a front view of the connector according to the first embodiment.

As shown in FIG. 2, bolts 118 and 120 are fastened, and thereby shield shell 102 is fixed to housing 128, on a side where connector portion 122 is provided. Shield shell 102 is provided with a clamp 100 on a side where cables 124, 125 and 126 are provided. Clamp 100 is formed of a rod-like metal plate by press molding or the like. Clamp 100 is formed into a predetermined shape to arch over shield shell 102. A central portion of clamp 100 is fixed to shield shell 102 by caulking so that it is integrally formed with shield shell 102, while both ends of clamp 100 are fixed to housing 128 by fastening bolts 114 and 116. At this time, the fixed state of the cables established by clamp 100 according to the present embodiment is such a state as to allow for more movement of a fixed point between clamp 100 and shield shell 102, namely, an object to be fixed, on the cable side, than does the fixed state of shield shell 102 established by bolts 118 and 120.

In other words, portions of clamp 100, from its central portion caulked to shield shell 102 to both of its end portions fixed to housing 128 by fastening bolts 114 and 116, are bent to have elasticity. By forming the portions of clamp 100, from its central portion to both of its end portions, to have elasticity, shield shell 102 fixed to clamp 100 is allowed to move, on the cable side.

Furthermore, shield shell 102 is connected, on the cable side, to cable cover 104. Cable cover 104 is formed of, for example, but not limited thereto, a heat-shrinkable tube. A clamp 108 is fixed to cable cover 104, on the cable side of cable cover 104. Although a technique of fixing clamp 108 is not particularly limited, clamp 108 is fixed to cable cover 104 by caulking or the like.

Clamp 108 is formed in such a manner that a rod-like metal plate is formed into a predetermined shape as in clamp 100, and then provided. A central portion of clamp 108 is fixed to cable cover 104 by caulking or the like. Both of end portions of clamp 108 are fixed to housing 128 by fastening bolts 110 and 112.

Portions of clamp 108, from its central portion fixed to cable cover 104 to both of its end portions fixed to housing 128 by fastening bolts 110 and 112, are bent to have elasticity.

Figure 3:
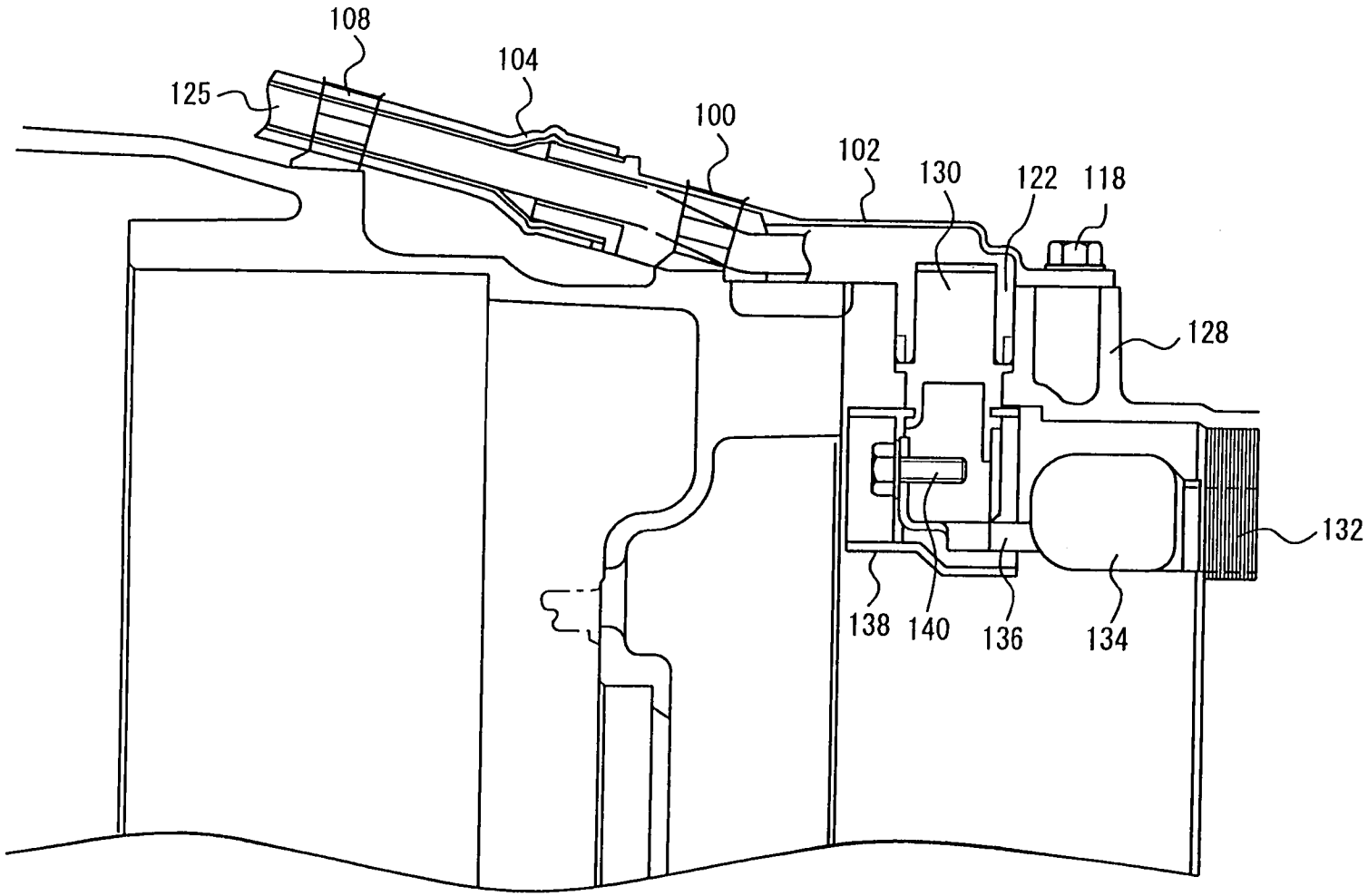
FIG. 3 is a cross section of the connector according to the first embodiment.

As shown in FIG. 3, a housing 128 accommodates a female connector 130, a terminal fixing base 138, a bolt 140, an end-of-connection portion 136, a coil 134, and a stator core 132.

Stator core 132, around which coil 134 is wound, is fixed to housing 128 by fastening a bolt or the like. Coil 134 is connected to end-of-connection portion 136. Terminal fixing base 138 is provided to restrict the movement of female connector 130 in a radial direction of the rotating electrical machine. Female connector 130 has a contact (not shown) therein. The contact is connected to end-of-connection portion 136 with bolt 140.

Male connector 200 has also a contact point (not shown) therein. By fitting male connector 200 into female connector 130, the contact point of male connector 200 and the contact of female connector 130 are joined together and connected electrically. Male connector 200 is fixed to housing 128 by bolt 118, which is provided on a side of shield shell 102 where the contact point is provided. Therefore, even if the cable 124 vibrates in accordance with a movement of the rotating electrical machine or a running state of the vehicle, connection between male connector 200 and female connector 130 is maintained. Clamp 100 on a side where the cable is provided is fixed to shield shell 102. Although a technique of fixing clamp 100 to shield shell 102 is not particularly limited, clamp 100 and shield shell 102 are fixed together by caulking or the like. Clamp 100 is fixed to housing 128 by bolts 114 and 116. Cables 124, 125 and 126 are fixed by clamp 108 with cable cover 104 interposed therebetween as described above. Clamp 108 is not particularly limited to be formed into the same shape as clamp 100. In other words, the clamp 108 may be formed such that a metal plate is bent into a predetermined shape that exhibits elasticity at least higher than that of clamp 100.

Figure 4A:
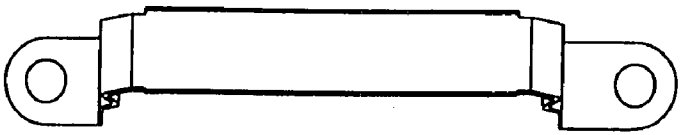
FIGS. 4A-4C are views each showing a clamp fixed to the connector according to the first embodiment.
Figure 4B:
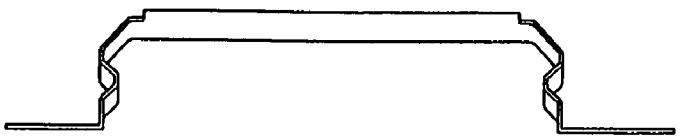
Figure 4C:
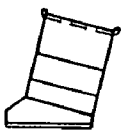

As shown in FIGS. 4A, 4B and 4C, clamp 100 or 108 is formed of a rod-like metal plate by press molding or the like. Each of the portions of clamp 100 or 108, from its central portion to both of its end portions, is formed into a bent shape. Accordingly, clamp 100 or 108 can be formed into a shape exhibiting elasticity.

A connector fixing structure having an above-described structure in accordance with the present embodiment is a structure for fixing, to a housing, a male connector to be connected to a female connector provided at a housing accommodating a vehicle-mounted rotating electrical machine. The male connector includes a contact point to be connected to a contact of the female connector, a cable to be connected to the contact point, and a shield shell covering the contact point. A fixing structure for the male connector includes a bolt for fixing the shield shell to a housing, on the contact side, and a clamp for fixing a cable to the housing, on the cable side. The fixed state of the cable established by the clamp is such a state as to allow for more movement of an object to be fixed (e.g. a fixed point between the shield shell and the clamp) than does the fixed state of the shield shell established by the bolt. By forming the clamp into a shape exhibiting elasticity, the fixed state on the cable side allows for movement. Therefore, if the cable vibrates in accordance with a movement of the rotating electrical machine or a running state of the vehicle, the clamp, which has a shape exhibiting elasticity, also vibrates in accordance with the vibrations in the cable. At this time, it is possible to allow the clamp to absorb the vibrations in the cable owing to its shape exhibiting elasticity. In other words, it is possible to disperse the stress caused by the vibrations and exerted on the cable. Therefore, it is possible to relieve the concentration of stress exerted on the cable. On the shield shell side of the male connector, in contrast, the shield shell is fixed to the housing by fastening the bolt, and thereby it is possible to maintain the connection between the contact point and the contact. Therefore, it is possible to provide a connector fixing structure that absorbs vibrations in a cable.

The clamp is integrally formed with the shield shell. Therefore, the number of fixed points for fixing the shield shell is increased, which can improve shielding performance. Furthermore, since the clamp is formed into a shape exhibiting elasticity, it is possible to absorb a positional offset, namely, a tolerance between the housing and the clamp at their fastened portion.

Furthermore, the male connector is formed to conform to the shape of the housing. Alternatively, the male connector is formed into an L-shape. Accordingly, if a thin plate is bent to form the clamp, it is possible to restrict the connector from bulging from the housing when the male connector is fit into the female connector. Therefore, even in a small space, it is possible to ensure a mounting space for the rotating electrical machine.

SECOND EMBODIMENT

Figure 5:
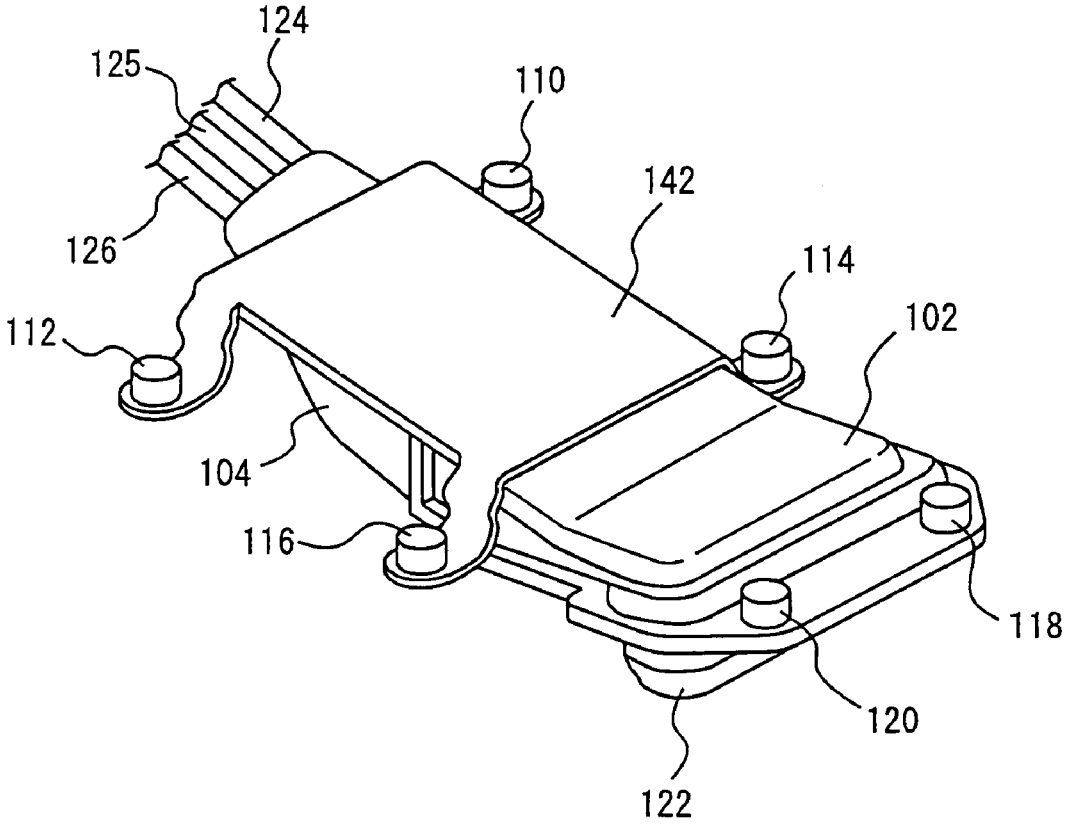
FIG. 5 is an external view of a connector according to a second embodiment of the present invention.

A connector fixing structure according to a second embodiment will now be described with reference to FIG. 5. A male connector 200 composing a connector according to the second embodiment includes a clamp 142 instead of clamps 100 and 108 at male connector 200 according to the first embodiment described above. Other structures are the same as those of the first embodiment. Therefore, the detailed description thereof will not be repeated here.

Clamp 142 is integrally formed with shield shell 102 by being fixed thereto by caulking or the like. Clamp 142 is a plate-like metal plate with four end portions. The four end portions are fixed to housing 128 with bolts 110-116, respectively.

Each of portions from the plate-like metal plate to the four end portions is formed into a shape exhibiting elasticity. Clamp 142 may further be fixed to cable cover 104 by caulking or the like.

As described above, a connector fixing structure according to the present embodiment has advantages similar to those of the connector fixing structure according to the first embodiment described above. In addition, the clamp is formed of a plate-like metal plate with its four end portions bent. By fixing the four end portions of the clamp to the housing, the clamp can be used as an elastic material having the vibrations in the cable, and a protective material for the cable as well.

It should be understood that the embodiments disclosed here are by way of illustration and examples only and are not to be taken by way of limitation. It is intended that the spirit and scope of the present invention is limited not by the description above, but by the terms of the appended claims, and that all the equivalents to the claims and all the modifications within the scopethereof are embraced.

The invention claimed is:

1. A connector fixing structure for a second connector to be connected to a first connector provided at a housing accommodating a vehicle-mounted electrical device, said second connector including a contact point to be connected to a contact of said first connector, a cable connected to said contact point, and a shielding portion covering said contact point, comprising:

a first fixing member for fixing said shielding portion to said housing, on a side where said contact point is provided; and a second fixing member for fixing said cable to said housing, on a side where said cable is provided, wherein a fixed state of said cable established by said second fixing member is such a state as to allow for more movement of an object to be fixed than does a fixed state of said shielding portion established by said first fixing member, and wherein said second fixing member is formed to have elasticity by its shape.

2. The connector fixing structure according to claim 1, wherein said object to be fixed is said shielding portion.

3. The connector fixing structure according to claim 1, wherein said object to be fixed is said shielding portion.

4. The connector fixing structure according to claim 1, wherein said second fixing member is a clamp formed of a metal plate bent into a predetermined shape to arch over said cable in two positions, and a bent shape is further formed at said clamp between said cable and said housing.

5. The connector fixing structure according to claim 1, wherein said second fixing member is formed of a metal plate bent into a predetermined shape.

6. The connector fixing structure according to claim 5, wherein said object to be fixed is said shielding portion.

7. The connector fixing structure according to claim 1, wherein said second fixing member is integrally formed with said shielding portion.

8. The connector fixing structure according to claim 7, wherein said object to be fixed is said shielding portion.

9. The connector fixing structure according to claim 1, wherein said second connector is formed to conform to a shape of said housing.

10. The connector fixing structure according to claim 9, wherein said object to be fixed is said shielding portion.

11. The connector fixing structure according to claim 1, wherein said second connector is formed into an L-shape.

12. The connector fixing structure according to claim 11, wherein said object to be fixed is said shielding portion.

13. The connector fixing structure according to claim 1, wherein said electrical device is a vehicle-mounted motor.

14. The connector fixing structure according to claim 13, wherein said object to be fixed is said shielding portion.

15. The connector fixing structure according to claim 1, wherein said fixing member is a clamp formed of a rod-like metal plate bent into a predetermined shape to arch over said cable, and a bent shape is further formed at said clamp between said cable and said housing.

16. The connector fixing structure according to claim 15, wherein two of the clamps are provided on the side where said cable is provided, with respect to said fixing member.

* * * * *